US011187049B2

(12) United States Patent
Gullaksen et al.

(10) Patent No.: US 11,187,049 B2
(45) Date of Patent: Nov. 30, 2021

(54) FINGERBOARD

(71) Applicant: Cameron International Corporation, Houston, TX (US)

(72) Inventors: Rolf Gullaksen, Richmond, TX (US); Erling Tambs, Kristiansand (NO); Kenneth Birkeland, Kristiansand (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 18 days.

(21) Appl. No.: 16/562,463

(22) Filed: Sep. 6, 2019

(65) Prior Publication Data

US 2020/0080390 A1 Mar. 12, 2020

Related U.S. Application Data

(60) Provisional application No. 62/727,804, filed on Sep. 6, 2018.

(51) Int. Cl.

| | |
|---|---|
| ***E21B 19/15*** | (2006.01) |
| ***E21B 19/20*** | (2006.01) |
| *E21B 15/00* | (2006.01) |

(52) U.S. Cl.

CPC ..... *E21B 19/155* (2013.01); *E21B 19/20* (2013.01); *E21B 15/00* (2013.01)

(58) Field of Classification Search

CPC ..... E21B 19/155; E21B 19/20; E21B 15/00
USPC ..... 166/77.51
See application file for complete search history.

(56) References Cited

U.S. PATENT DOCUMENTS

| | | | |
|---|---|---|---|
| 6,089,333 | A | 7/2000 | Rise |
| 6,513,605 | B1 | 2/2003 | Lodden |
| 6,725,949 | B2 | 4/2004 | Seneviratne |
| 6,821,071 | B2 | 11/2004 | Woolslayer et al. |
| 6,860,337 | B1 | 3/2005 | Orr et al. |
| 6,994,171 | B2 | 2/2006 | Orr et al. |
| 7,246,983 | B2 | 7/2007 | Zahn et al. |
| 7,510,028 | B2 | 3/2009 | Welsh |
| 7,654,313 | B2 | 2/2010 | Angman |
| 7,836,795 | B2 | 11/2010 | Vatne |

(Continued)

FOREIGN PATENT DOCUMENTS

| | | | |
|---|---|---|---|
| WO | 2017146592 | A1 | 8/2017 |
| WO | 2017196291 | A1 | 11/2017 |

(Continued)

*Primary Examiner* — Matthew R Buck
*Assistant Examiner* — Patrick F Lambe

(57) ABSTRACT

A fingerboard has a first portion configured to receive a first pipe and a second portion configured to receive a second pipe. The fingerboard includes a fixed section and a movable section, each having fingers and latches that define a pipe receiving space. The pipe receiving space of the fixed section is sized for drill pipe while the pipe receiving space of the movable section may be the same size as the pipe receiving space of the fixed section or a different size than the pipe receiving space of the fixed section. The movable section has a first and a second pipe receiving spaces. The second pipe receiving space may be larger than the first pipe receiving space. A hinge moves the movable section to selectively locate the first pipe receiving portion and the second pipe receiving portion adjacent to the fixed section. A mover, such as a hydraulic cylinder, is affixed to the movable section.

24 Claims, 11 Drawing Sheets

(56) References Cited

U.S. PATENT DOCUMENTS

| | | | |
|---|---|---|---|
| 8,037,786 | B2 | 10/2011 | Vatne |
| 8,052,370 | B2 | 11/2011 | Dekker et al. |
| 8,136,603 | B2 | 3/2012 | Schneider |
| 8,172,497 | B2 | 5/2012 | Orgeron et al. |
| 8,192,128 | B2 | 6/2012 | Orgeron |
| 8,250,816 | B2 | 8/2012 | Donnelly et al. |
| 8,317,448 | B2 | 11/2012 | Hankins et al. |
| 8,439,128 | B2 | 5/2013 | Vatne |
| 8,550,761 | B2 | 10/2013 | Belik et al. |
| 8,678,112 | B2 | 3/2014 | Vatne |
| 8,720,128 | B2 | 5/2014 | Vogt |
| 8,813,436 | B2 | 8/2014 | Donnelly et al. |
| 8,876,452 | B2 | 11/2014 | Orgeron et al. |
| 8,904,716 | B2 | 12/2014 | Donnelly et al. |
| 8,961,093 | B2 | 2/2015 | Springett et al. |
| 9,091,128 | B1 | 7/2015 | Orgeron et al. |
| 9,121,234 | B2 | 9/2015 | Flusche |
| 9,163,462 | B2 | 10/2015 | Donnelly et al. |
| 9,303,468 | B2 | 4/2016 | Selzer et al. |
| 9,334,668 | B2 | 5/2016 | Wijning et al. |
| 9,354,623 | B2 | 5/2016 | Magnuson |
| 9,441,423 | B2 | 9/2016 | Donnally et al. |
| 9,574,402 | B2 | 2/2017 | Hause |
| 9,650,840 | B2 | 5/2017 | Cheng et al. |
| 10,060,187 | B2 | 8/2018 | Roodenburg et al. |
| 10,060,199 | B2 | 8/2018 | Reddy et al. |
| 10,060,200 | B2 | 8/2018 | Rice, II |
| 10,073,446 | B1 | 9/2018 | Snow et al. |
| 10,094,136 | B2 | 10/2018 | Konduc et al. |
| 10,094,176 | B2 | 10/2018 | Reddy et al. |
| 10,125,512 | B2 | 11/2018 | Allen et al. |
| 10,132,660 | B2 | 11/2018 | Newton et al. |
| 10,145,188 | B2 | 12/2018 | Smith et al. |
| 10,214,975 | B2 | 2/2019 | Holand et al. |
| 10,253,572 | B2 | 4/2019 | Braniff |
| 10,267,103 | B2 | 4/2019 | Rice, II |
| 10,294,739 | B2 | 5/2019 | Orr et al. |
| 10,323,466 | B2 | 6/2019 | Price et al. |
| 10,329,841 | B2 | 6/2019 | Van Duivendijk et al. |
| 10,443,325 | B2 | 10/2019 | Zheng et al. |
| 10,465,455 | B2 | 11/2019 | Berry et al. |
| 10,508,494 | B2 | 12/2019 | Metz |
| 10,513,895 | B2 | 12/2019 | Holand et al. |
| 10,544,633 | B2 | 1/2020 | Huchon |
| 10,648,253 | B2 | 5/2020 | Kaasin |
| 2015/0315855 | A1 | 11/2015 | Dewald et al. |
| 2016/0090796 | A1* | 3/2016 | Roodenburg ..... E21B 15/02 414/22.66 |
| 2016/0291201 | A1 | 10/2016 | Tunc et al. |
| 2018/0128064 | A1* | 5/2018 | Gupta ..... E21B 19/14 |
| 2018/0216423 | A1 | 8/2018 | Henriksen et al. |
| 2018/0274321 | A1 | 9/2018 | Arefi et al. |
| 2018/0292242 | A1 | 10/2018 | Newton et al. |
| 2018/0321064 | A1 | 11/2018 | Newton et al. |
| 2018/0321331 | A1 | 11/2018 | Finlay et al. |
| 2018/0328112 | A1 | 11/2018 | Berry et al. |
| 2018/0328124 | A1 | 11/2018 | Finlay et al. |
| 2018/0363392 | A1 | 12/2018 | Brandsvoll et al. |
| 2019/0023538 | A1 | 1/2019 | Pletz et al. |
| 2019/0048665 | A1 | 2/2019 | Rodriguez et al. |
| 2019/0128077 | A1 | 5/2019 | Holand et al. |
| 2019/0145194 | A1 | 5/2019 | Berry et al. |
| 2019/0145224 | A1 | 5/2019 | Berry et al. |
| 2019/0271199 | A1 | 9/2019 | McCabe et al. |

FOREIGN PATENT DOCUMENTS

| | | | |
|---|---|---|---|
| WO | 2018045259 | A1 | 3/2018 |
| WO | 2018175832 | A1 | 9/2018 |
| WO | 2018195028 | A1 | 10/2018 |

* cited by examiner

FINGERBOARD

CROSS REFERENCE TO RELATED APPLICATIONS

This application claims the priority of U.S. Provisional Patent Application No. 62/727,804 titled "FINGERBOARD," filed Sep. 6, 2018, the contents of which are hereby incorporated by reference.

BACKGROUND OF THE INVENTION

This section is intended to introduce the reader to various aspects of art that may be related to various aspects of the present disclosure, which are described or claimed below. This discussion is believed to be helpful in providing the reader with background information to facilitate a better understanding of the various aspects of the present disclosure. Accordingly, it should be understood that these statements are to be read in this light, and not as admissions of prior art.

This present disclosure relates to pipe handling equipment used on various drilling rigs, like jackup rigs, semisubmersible rigs, drill ships, or land rigs, and, in particular, to fingerboards.

Drilling tubulars include drill pipe, tubing, and casing ("tubulars"). Drilling tubulars are assembled by threading one section of tubular to the next. Management of tubulars on the drill floor is conducted by various pipe handling components and features that retrieve a tubular, position the tubular into the mousehole, and tighten one tubular to the next.

One of these handling components is the fingerboard. During well operation, it is common for the drill string to be pulled from the bore to facilitate changing of the drill bit or for other reasons. The drill pipe is pulled from the bore and a stand is unthreaded from the drill string. The upper end of the stand is disconnected from the traveling block. The upper end of the stand is placed between a set of racking fingers on a fingerboard which support the stand in a substantially vertical position.

A typical fingerboard includes slots defined by beams known as fingers. A multiplicity of latches are arranged on each finger. Latches are positionable between a horizontal orientation and a vertical orientation. A space is defined between adjacent fingers and adjacent horizontally oriented latches for receiving a single stand of drill pipe. A latch is positioned between each stand of drill pipe. The latches are typically pneumatically operated.

SUMMARY OF THE INVENTION

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

A land rig includes drilling equipment for drilling a subterranean well and for producing hydrocarbon-bearing fluid from a subterranean rock formation. The land rig includes tubular handling equipment, a controls skid to power and functionally control the drilling and pressure control equipment, a pressure control system like a blowout preventer (BOP) for controlling pressure of the well and a manifold system to direct and manage fluids to and from mud pumps.

The various equipment and tools of the rig may be monitored and controlled from a drilling control room (DCR), located on the rig floor.

A multi-part fingerboard is provided for use when there is a requirement for both drill pipes and casing pipes. The disclosed fingerboard might also be used for offshore rigs, such as platform rigs, MODU's (jack-ups, semi submersibles, drill ships, etc.).

In one embodiment, the fingerboard of the invention is a 2-in-one fingerboard that can hinge around a support and quickly be converted from a drill pipe fingerboard to a casing fingerboard—or the other way around.

In embodiments of the disclosure, the finger board can be used with various types of pipe rackers, such as Cameron® SmartRacker™ (x-y Racker), or a parallel racker or a bridge racker as well as a so called 2-Arm System.

The disclosed fingerboard enables a quick change from a fingerboard that is configured for drill pipe to a fingerboard that is configured for both drill pipe and casing.

The quick change is achieved by assigning part of the fingerboard to both drill pipe and casing with a hinged section. In embodiments, the fingerboard has a movable section with two fingerboard portions installed as an angled assembly, e.g., a 90 degrees assembly where one portion of the 90 degree assembly is configured for drill pipes and the other portion of the 90 degree assembly is configured for the chosen casing size (for example 9⅝"). Capacity of the various tubular sizes might be adjusted when the fingerboard (s) is designed or as desired.

In embodiments, the movable section includes two "halves" that are activated by a rotating device or mover, e.g., a hydraulic cylinder. The mover may be remotely operated from a drilling control system. The control system may also be able to interface with the controls for a pipe handling system in such a way that the pipe handler might be configured according to the fingerboard configuration being used.

In embodiments, part of the fingerboard might be "hinged". The "hinged" part of the fingerboard might be configured for drill pipe and the other "half" of the hinged fingerboard might be configured for casing. In embodiments, controls might be integrated (into the rig control system) to automatically control the fingerboard (casing or drill pipe configuration). In embodiments, controls might be integrated to position and reach of the pipe racker.

According to some embodiments, it is disclosed a fingerboard that can handle both casing and drill pipes.

In greater detail, in one embodiment, the fingerboard of the invention includes a fixed fingerboard section and a movable fingerboard section.

The fixed fingerboard section has a drill pipe receiving space for receiving a tubular having a drill pipe diameter. The fixed fingerboard section has at least two fingers defining a slot, the fixed fingerboard section having a plurality of latches arranged between the fingers for defining the drill pipe receiving space. Each latch of the plurality of latches of the fixed fingerboard section is selectively movable between an open position and a closed position.

The movable fingerboard section has a first pipe receiving portion defining a first pipe receiving space and a second pipe receiving portion defining a second pipe receiving space.

The first pipe receiving portion has at least two fingers defining a first pipe receiving slot and a plurality of latches arranged between the fingers for defining the first pipe receiving space for receiving a first pipe having a first diameter.

The second pipe receiving portion has at least two fingers defining a second pipe receiving slot and a plurality of latches arranged between the fingers for defining the second pipe receiving space for receiving a second pipe having a second diameter.

The first pipe receiving portion and the second pipe receiving portion are offset at an angle, e.g., wherein the angle is at least 90 degrees. In one embodiment, the angle is 90 degrees. In one embodiment, when the first pipe receiving portion is vertical, the second pipe receiving portion is horizontal and when the second pipe receiving portion is vertical, the first pipe receiving portion is horizontal.

The first pipe receiving space may be the same size as drill pipe receiving space. The the second pipe receiving space may be larger than the first pipe receiving space. The second pipe receiving space is sized to receive casing.

A hinge is connected to the first pipe receiving portion and the second pipe receiving portion of the movable fingerboard section for selectively positioning the movable fingerboard section in a first position wherein the first pipe receiving portion is adjacent the fixed fingerboard section. The hinge additionally facilitates selectively positioning the movable fingerboard section in a second position wherein the second pipe receiving portion is adjacent to the fixed fingerboard section. The hinge may be horizontally oriented.

The first pipe receiving space is a different size than the second pipe receiving space for receiving tubulars of different diameters.

A mover is affixed to the movable fingerboard section for moving the movable fingerboard section into the first position and into the second position. The mover may be a hydraulic cylinder. The mover is activated by controls. The mover may be controlled via a control system, wherein the controls of the mover interface with controls of a pipe handling system.

BRIEF DESCRIPTION OF THE DRAWINGS

The subject disclosure is further described in the following detailed description, and the accompanying drawing and schematic of non-limiting embodiment of the subject disclosure.

The features depicted in the figure are not necessarily shown to scale. Certain features of the embodiments may be shown exaggerated in scale or in somewhat schematic form, and some details of elements may not be shown in the interest of clarity and conciseness.

DETAILED DESCRIPTION OF THE PREFERRED EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
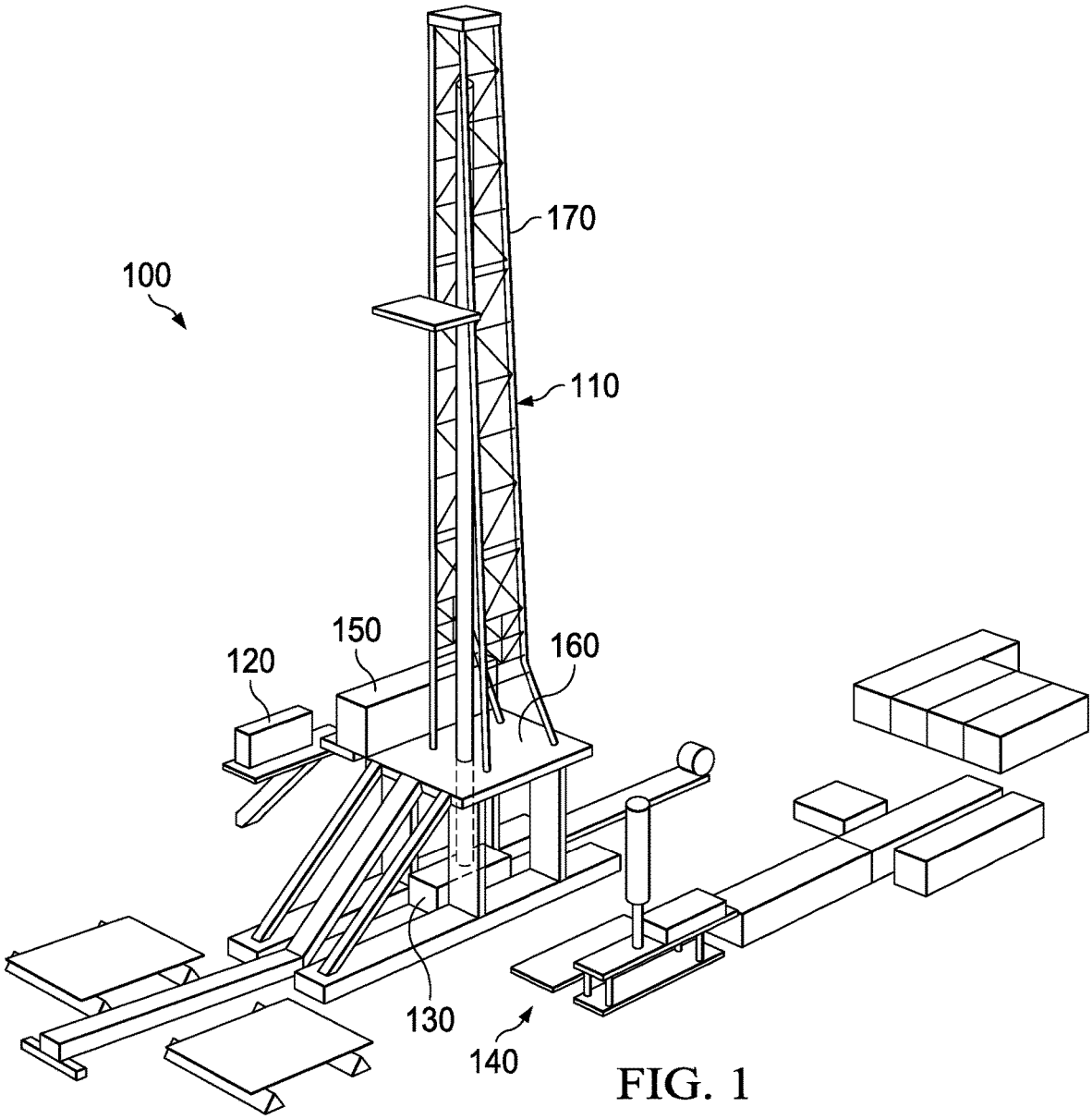
FIG. 1 is a representation of an example of an environment in which one or more of the pipe handling system of the present disclosure might be deployed.
Figure 2A:
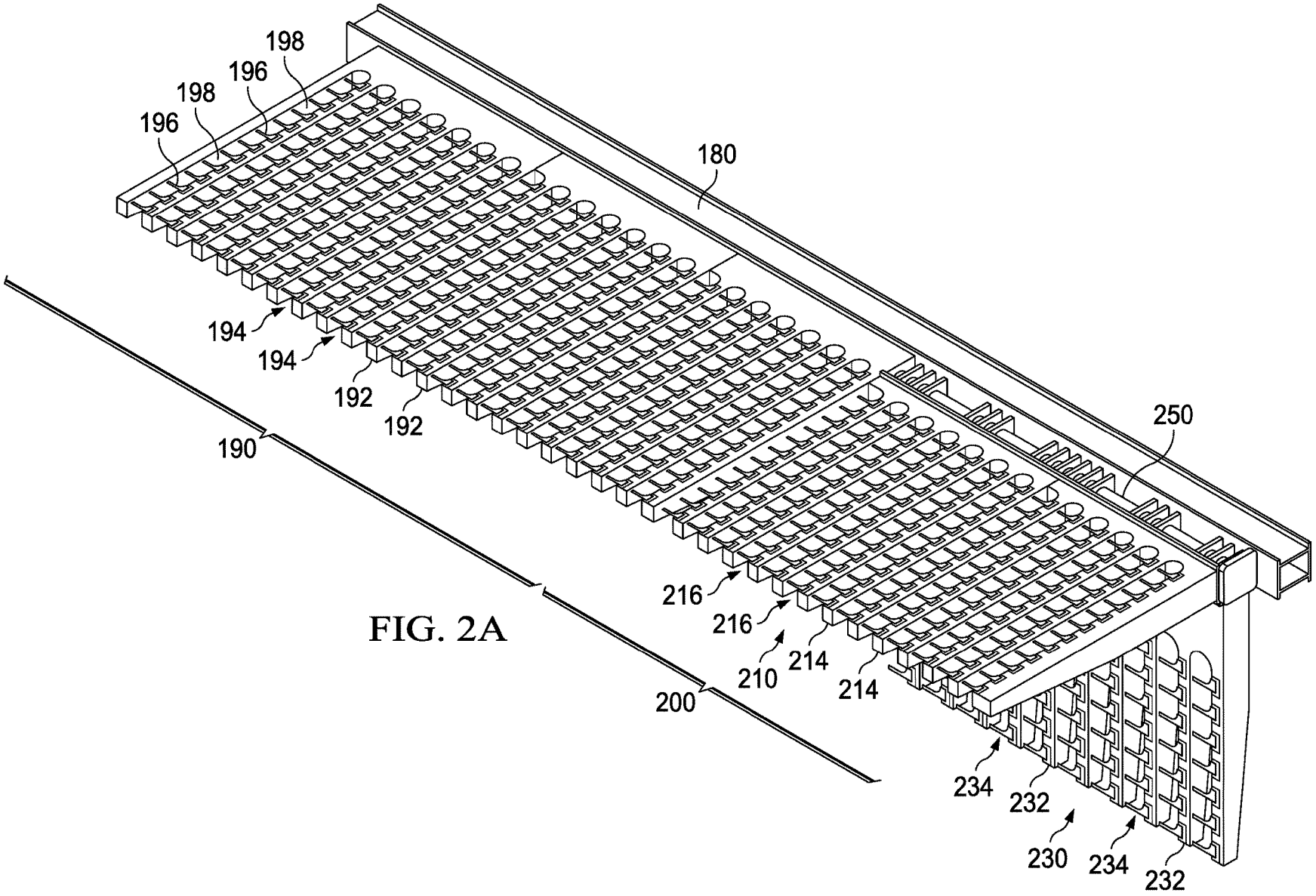
FIG. 2A is a perspective view of fingerboards of the invention shown with a movable fingerboard section positioned with a first pipe receiving portion adjacent to a fixed fingerboard section.
Figure 2B:
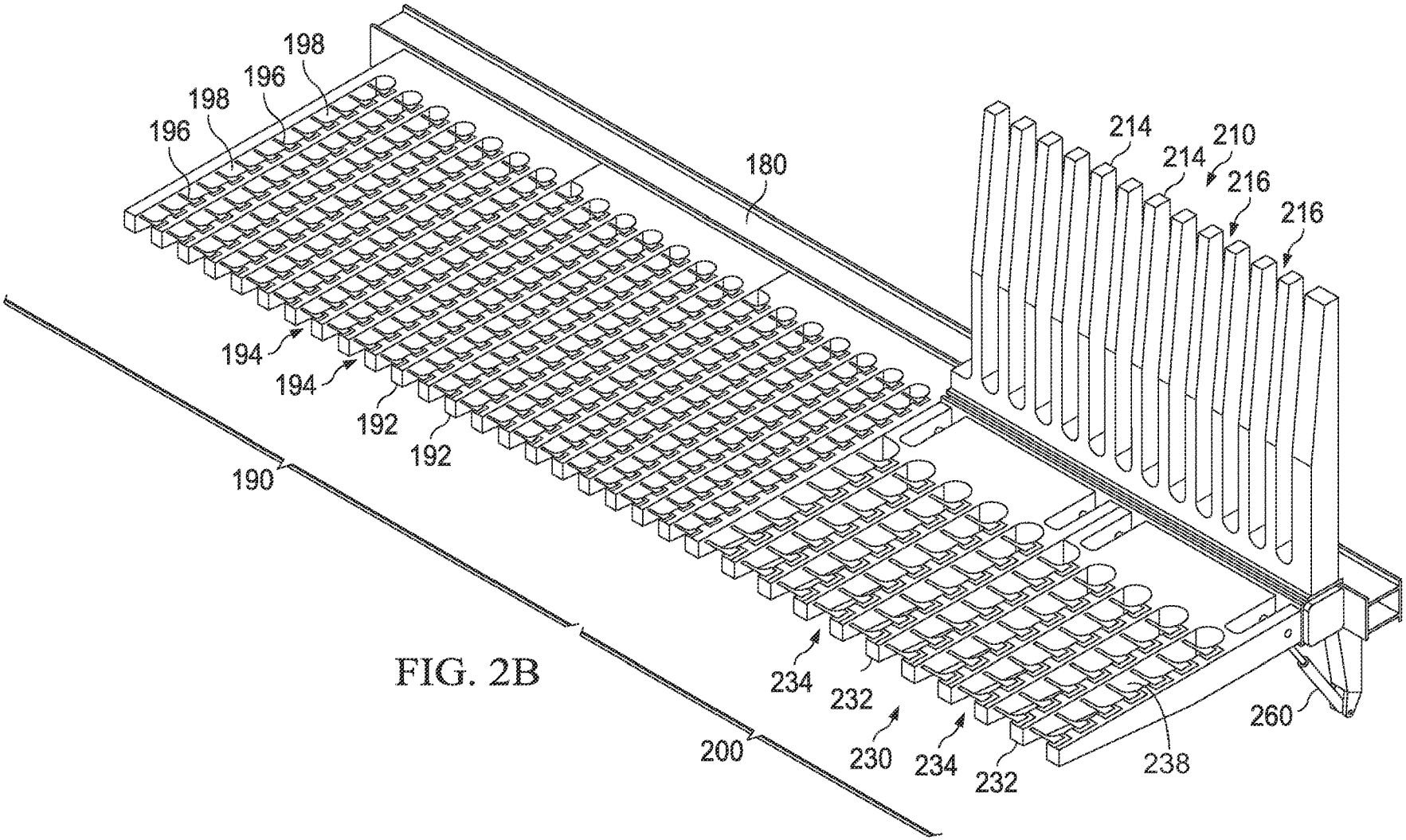
FIG. 2B is a perspective view of fingerboards of the invention shown with the movable fingerboard section positioned with a second pipe receiving portion adjacent to a fixed fingerboard section.
Figure 2C:
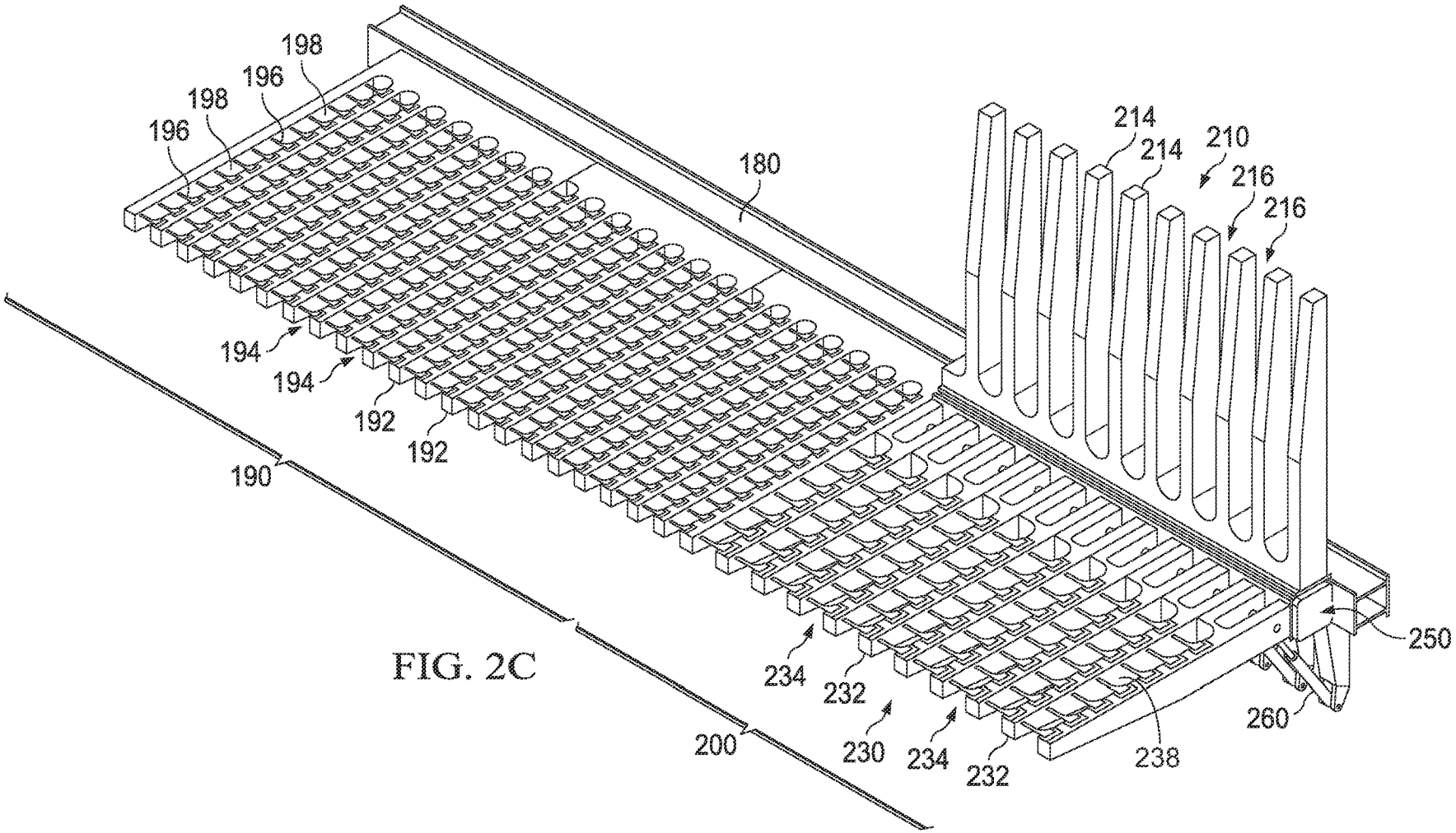
FIG. 2C is a perspective view of another embodiment of fingerboards of the invention shown with the movable fingerboard section positioned with a second pipe receiving portion adjacent to a fixed fingerboard section.
Figure 3A:
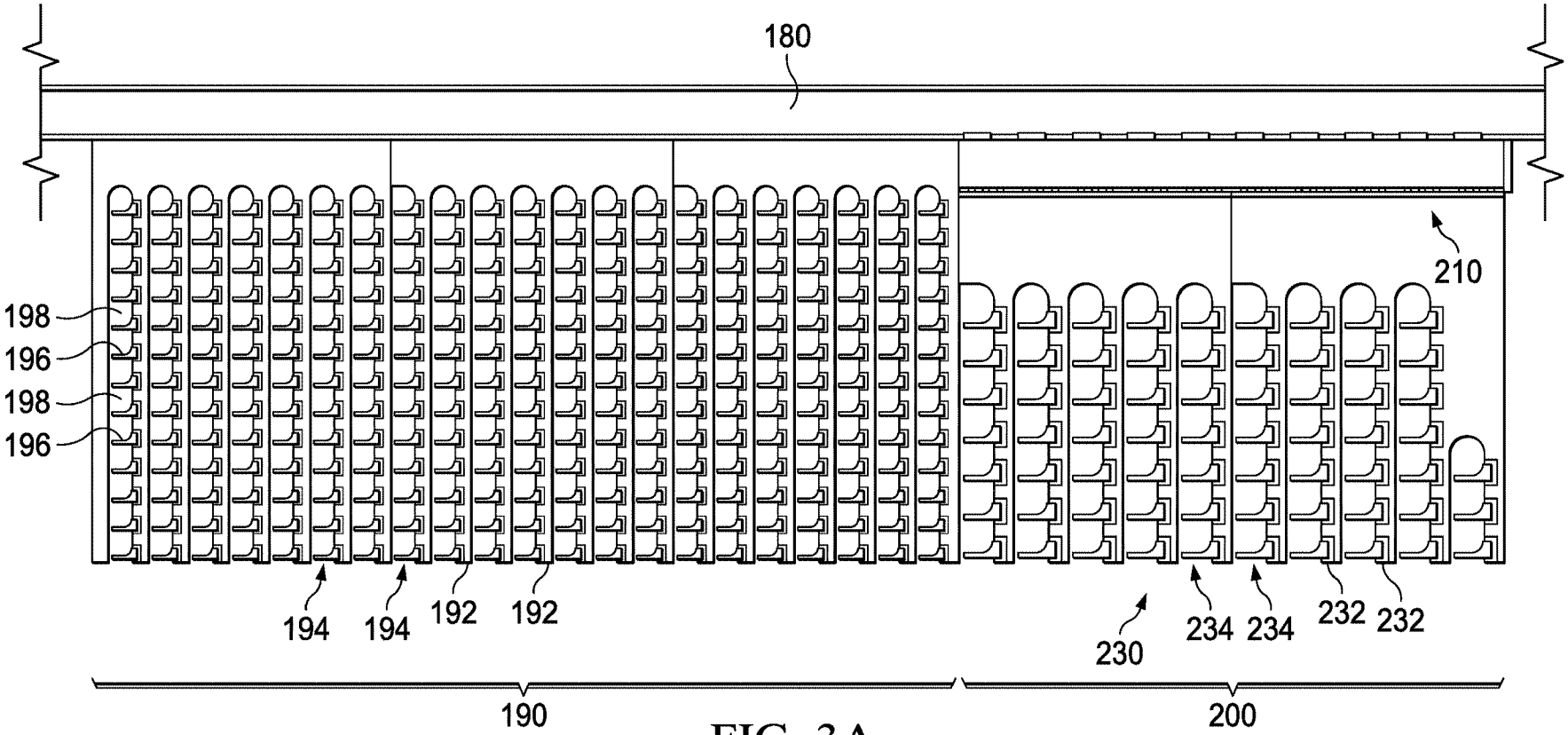
FIG. 3A is a plan view of fingerboards of the invention shown with the movable fingerboard section positioned with the second pipe receiving portion adjacent to the fixed fingerboard section.
Figure 3B:
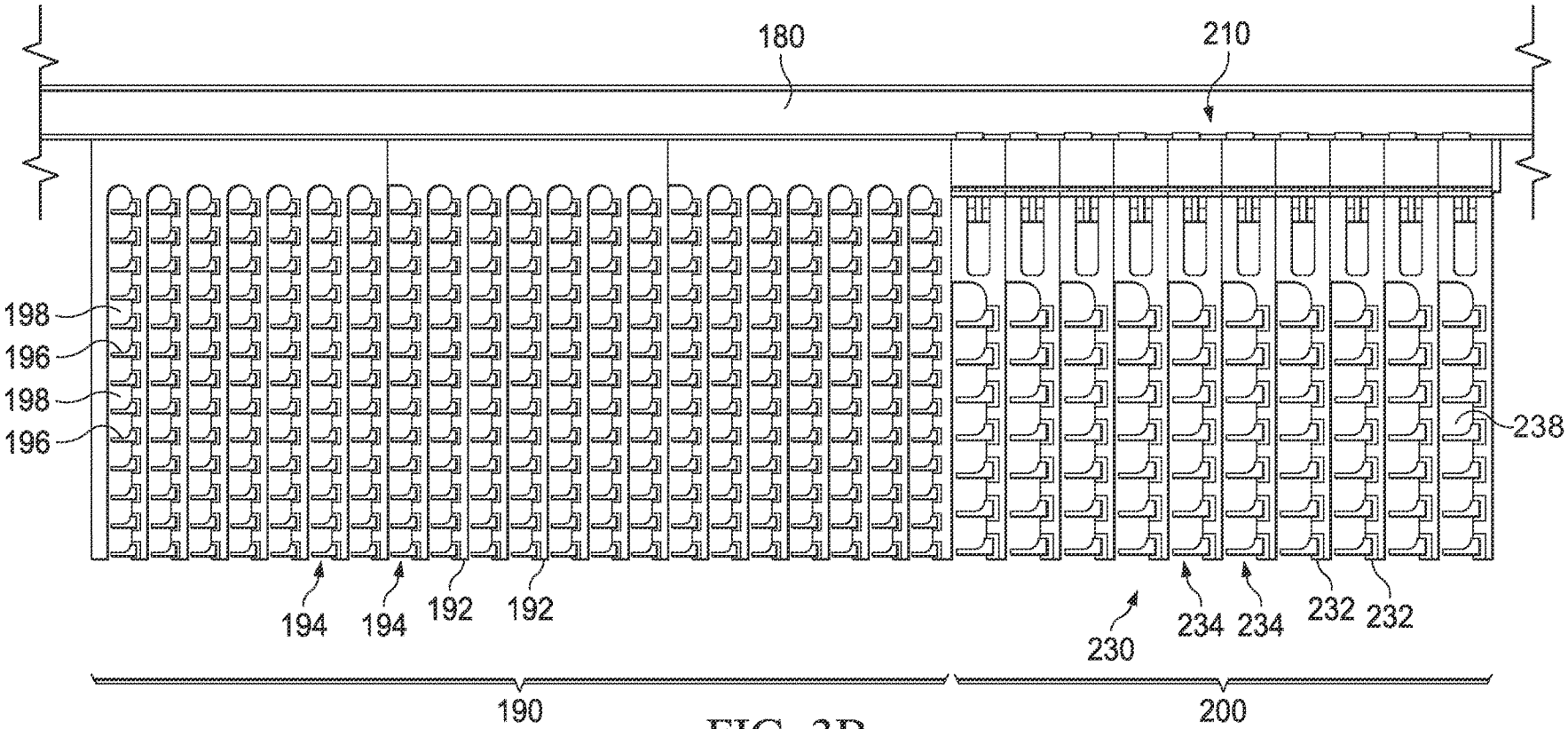
FIG. 3B is a plan view of another embodiment of fingerboards of the invention shown with the movable fingerboard section positioned with the second pipe receiving portion adjacent to the fixed fingerboard section.
Figure 4A:
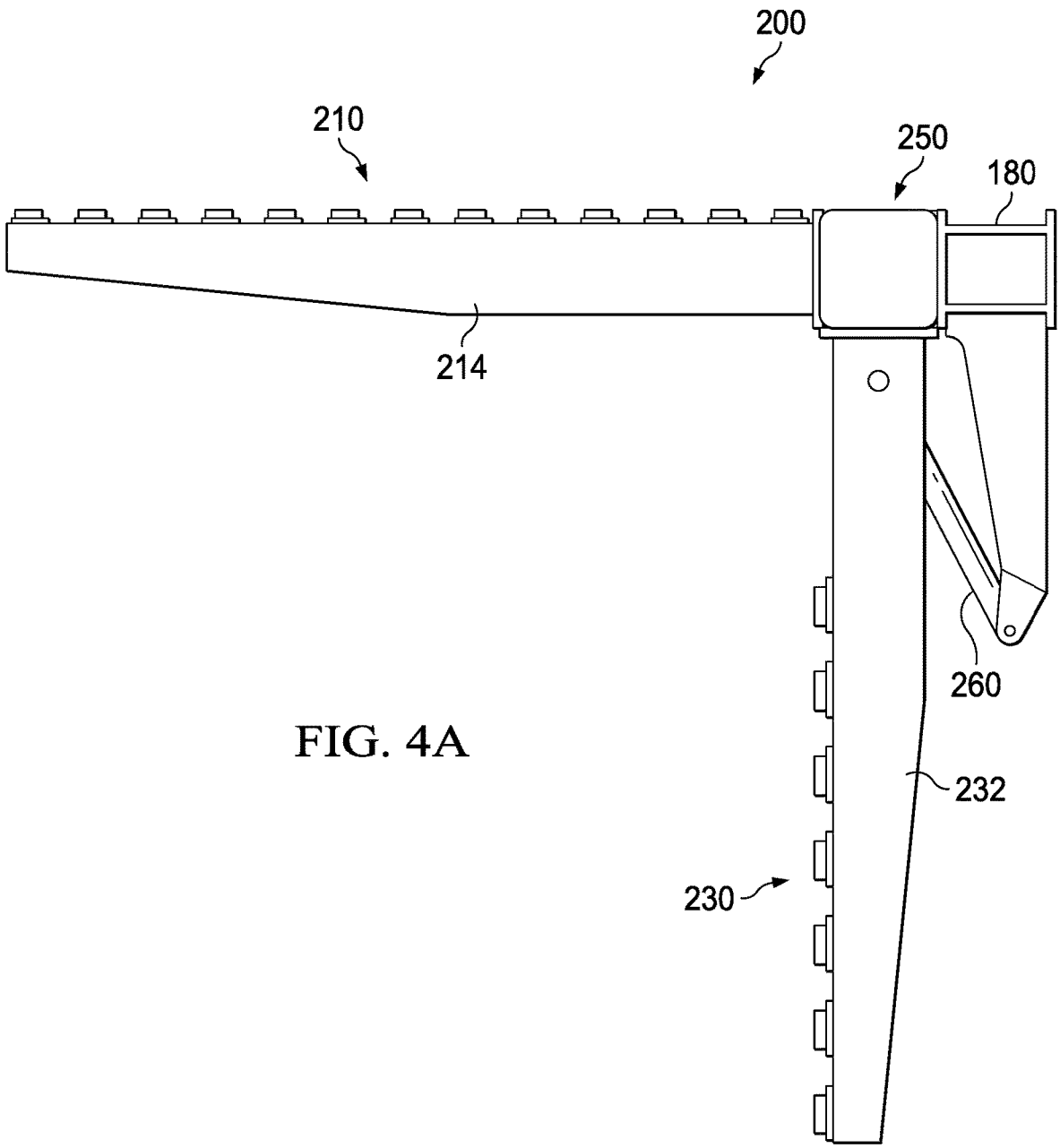
FIG. 4A is an elevation view of the movable fingerboard section of FIGS. 2-3B shown with the first pipe receiving portion in a horizontal position.
Figure 4B:
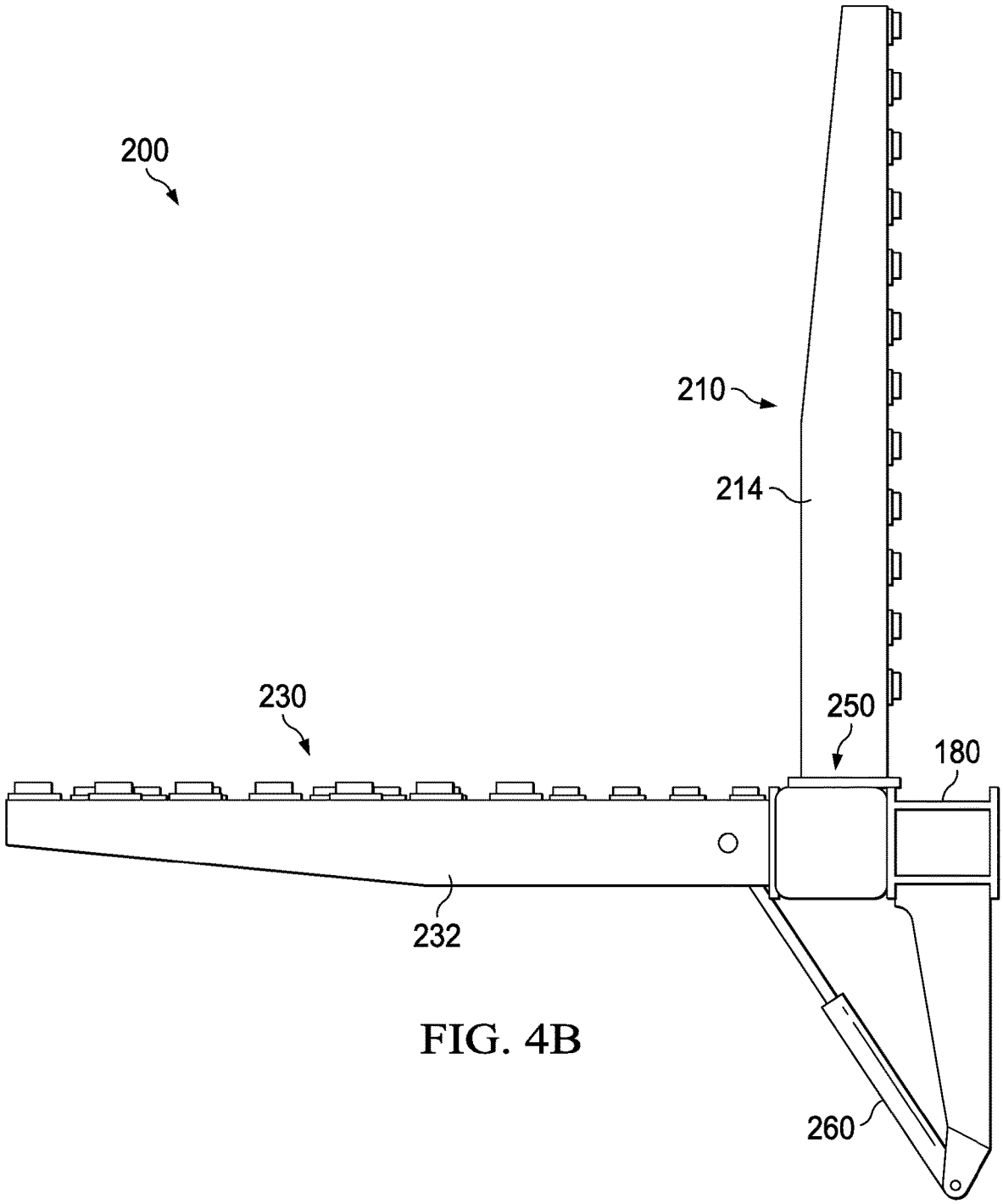
FIG. 4B is an elevation view of the movable fingerboard section of FIGS. 2-4A shown with the second pipe receiving portion in a horizontal position.
Figure 5:
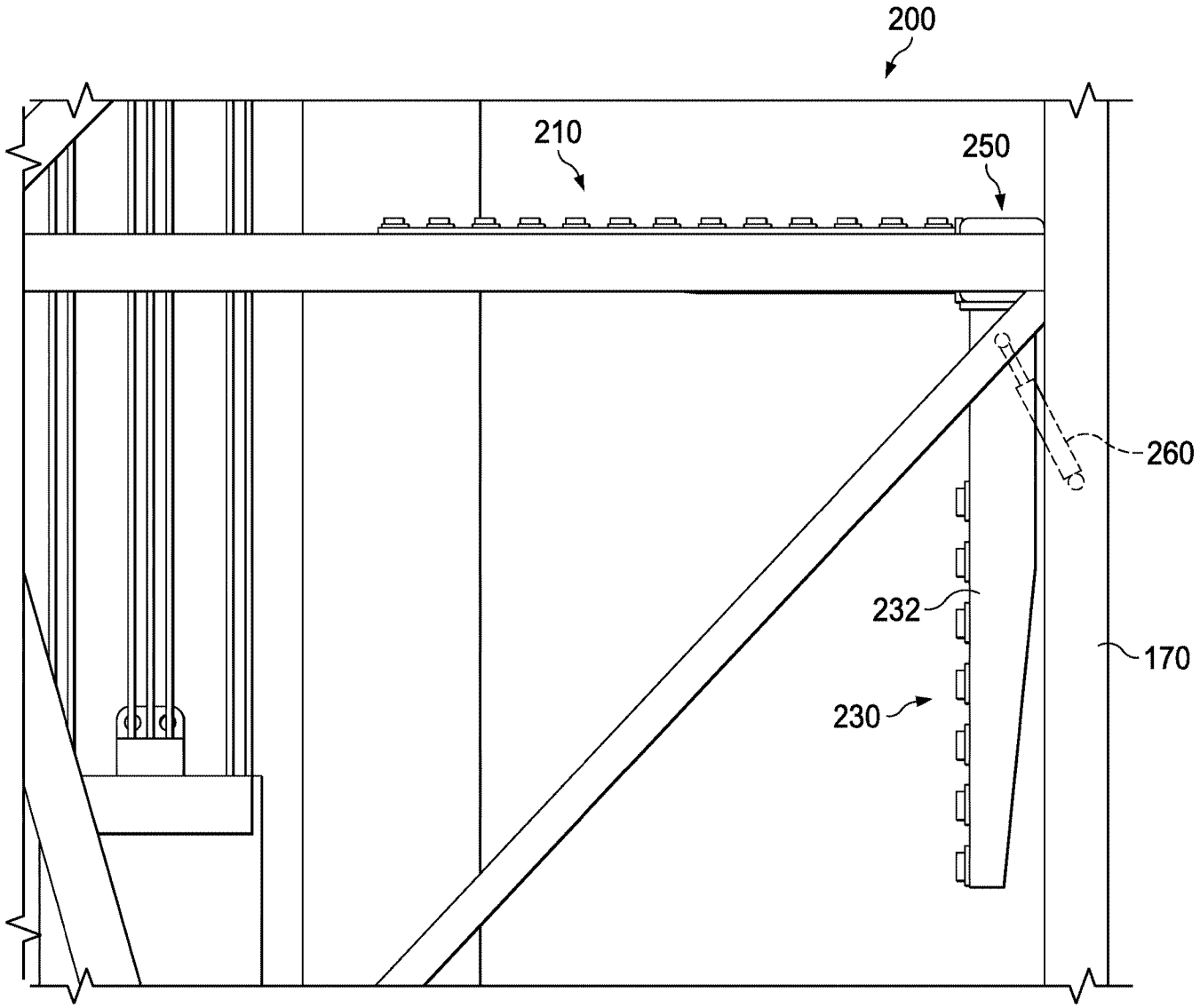
FIG. 5 is an elevation view of the movable fingerboard section of FIGS. 2-4B shown attached to support structure with the first pipe receiving portion in a horizontal position.
Figure 6A:
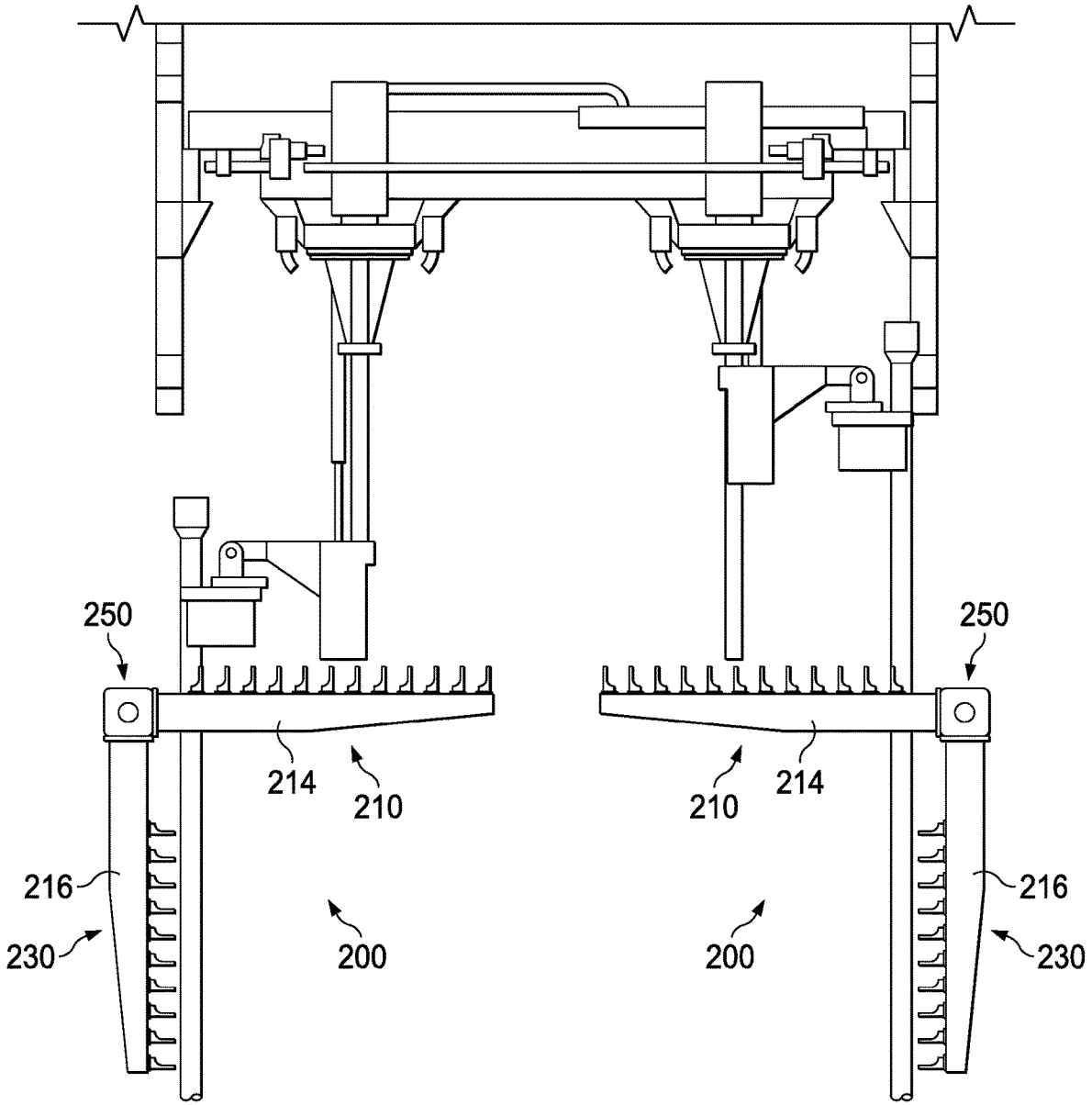
FIG. 6A is an elevation view of a pair of movable fingerboard sections shown attached to support structure with the first pipe receiving portions in a horizontal position.
Figure 6B:
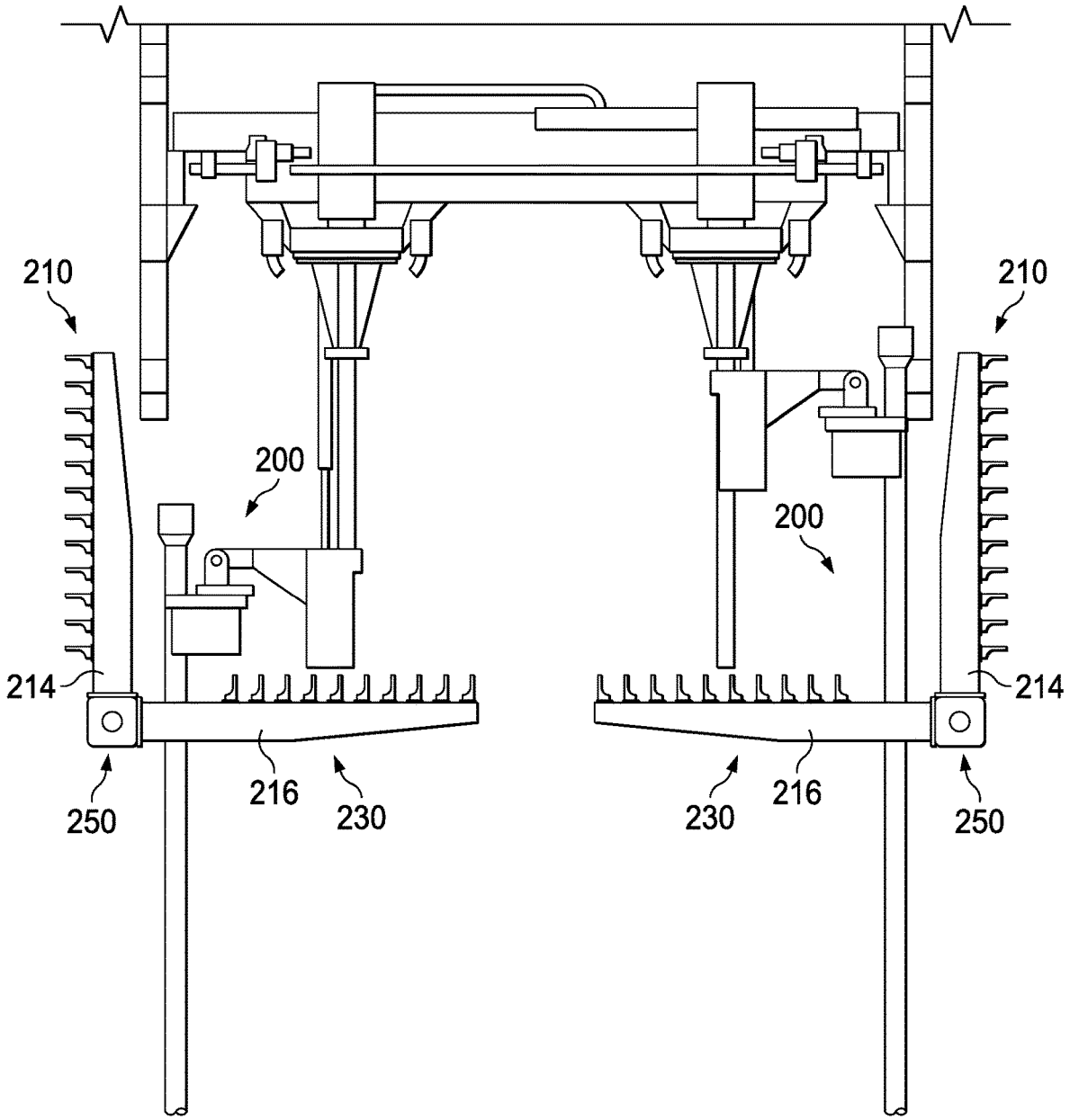
FIG. 6B is an elevation view of a pair of movable fingerboard sections shown attached to support structure with the second pipe receiving portions in a horizontal position.

FIG. 1 is a diagram illustrating an example of the environment in which one or more of the fingerboard of the present disclosure might be deployed. A land rig 100 is shown that comprises drilling equipment to drill a subterranean well and produce hydrocarbon-bearing fluid from such subterranean rock formation. The land rig 100 includes tubular handling equipment generally shown as 110, controls skid 120 to power and functionally control the drilling and pressure control equipment, a pressure control system like a blowout preventer (BOP) 130 to control pressure of the well and a manifold system 140 to direct and manage fluids to and from mud pumps. The various equipment and tools of the rig 100 might be monitored and controlled from a drilling control room (DCR) 150, located on the rig floor 160. In embodiments, the disclosed fingerboard might also be used for offshore rigs, such as platform rigs, MODU's (jack-ups, semi submersibles, drill ships, etc.).

Support structure 180 (FIGS. 2A-4B) is affixed to derrick 170. Support structure 180 is for supporting fixed fingerboard section 190 and movable fingerboard section 200.

Fixed fingerboard section 190 (FIGS. 2A-3B) has at least two fingers 192 that define slot 194. Fixed fingerboard section 190 includes a plurality of latches 196 arranged between fingers 192 for defining a drill pipe receiving space 198 for receiving a tubular, such as a drill pipe, having a drill pipe diameter. Each latch 196 of fixed fingerboard section 190 is selectively movable between an open, e.g., vertical, position and a closed, e.g., horizontal, position.

Movable fingerboard section 200 (FIGS. 2A-6B) has a first pipe receiving portion 210 and a second pipe receiving portion 230. First pipe receiving portion 210 has at least two fingers 214 for defining a first pipe receiving slot 216 for receiving a first pipe having a first diameter. In one embodiment, the drill pipe diameter of drill pipe is equal to the first diameter of first pipe. In one embodiment, first pipe is also drill pipe.

Second pipe receiving portion 230 has at least two fingers 232 defining a second pipe receiving slot 234 and a plurality of latches 236 between fingers 232 for defining a second pipe receiving space 238 for receiving a second pipe having a second diameter. In one embodiment, a second diameter of a second pipe is larger than the first diameter of a first pipe. In one embodiment, the second pipe is casing.

Hinge 250 is affixed to support structure 180. Hinge 250 is connected to first pipe receiving portion 210 and second pipe receiving portion 230 of movable fingerboard section 200 for selectively positioning movable fingerboard section 200 in a first position wherein first pipe receiving portion 210 is adjacent to fixed fingerboard section 190 (see, e.g., FIGS. 1, 4A, 4B, 8). Hinge 250 is additionally for selectively positioning movable fingerboard section 210 in a second position wherein second pipe receiving portion 230 is adjacent to fixed fingerboard section 190 (see, e.g., FIGS. 3A, 3B, 5-7, 9).

When hinge 250 is horizontally oriented, first pipe receiving portion 210 and second pipe receiving portion 230 of movable fingerboard section 200 are offset from one another by an angle. In one embodiment, first pipe receiving portion 210 has an angular offset from second pipe receiving portion 230 of at least 90 degrees. In one embodiment, first pipe receiving portion 210 has an angular offset of 90 degrees from second pipe receiving portion 230. In one embodiment, when first pipe receiving portion 210 is vertical, then second pipe receiving portion 230 is horizontal. Additionally, in one embodiment, second pipe receiving portion 230 is vertical when first pipe receiving portion 210 is horizontal.

Mover 260 (FIGS. 2B, 2C, and 4A-5) is provided for moving movable fingerboard section 200 from the first position to the second position.

In another embodiment, hinge 250 may be vertically oriented. In the vertical orientation, movable fingerboard section 200 includes a first pivoting pipe receiving portion and a second pivoting pipe receiving portion. The first pivoting pipe receiving portion and the second pivoting pipe receiving portion are fixed to a hinge and are offset from one another by an angle. In one embodiment, the first pivoting pipe receiving portion is angularly offset from the second pivoting pipe receiving portion by at least 90 degrees. In one embodiment, first pivoting pipe receiving portion has an angular offset of 90 degrees from second pivoting pipe receiving portion. In embodiments having a vertical hinge, pivoting pipe receiving portions are selectively swiveled into a position adjacent to fixed fingerboard section 190.

A mover is provided for moving movable fingerboard section 200 from the first position to the second position.

The fingerboard of the disclosure is intended to be used when there is a requirement for (a lot of) both drill pipes and casing pipes.

A two-in-one fingerboard is disclosed that can hinge around its support 180 and quickly be converted from a drill pipe fingerboard to a casing fingerboard—or the other way around.

In embodiments of the disclosure, the finger board can be used with various types of pipe rackers, such as Cameron® SmartRacker™ (x-y Racker), or a parallel racker or a bridge racker as well as a so called 2-Arm System.

In embodiments, one or both of the fingerboards to be configured as shown on the attached sketches. The disclosed fingerboard enables to quickly change from a fingerboard that is configured for drill pipe to a fingerboard that is configured for both drill pipe and casing.

The change in configuration is achieved by assigning part of the fingerboard to both drill pipe and casing with a hinged section as shown in FIGS. 2-6B. In embodiments, the fingerboard comprises two fingerboard portions 210, 230 installed as an angled movable unit 200, for example a 90 degrees unit where one of the 90 degree units is configured for drill pipes and the other 90 degrees "half" is configured for the chosen casing size (for example 9⅝"). Capacity of the various tubular sizes might be adjusted when the fingerboard(s) is designed or as desired.

In embodiments, the two "halves" of the fingerboard might be activated by a rotating device or mover 260—for example hydraulic cylinders—that might be remotely operated from a drilling control system. The control system might also be able to interface with the controls for a pipe handling system in such a way that the pipe handler might be configured according to the fingerboard configuration being used.

In embodiments, part of the fingerboard might be "hinged", i.e. the "hinged" part of the fingerboard might be configured for drill pipe and the other "half" of the hinged fingerboard might be configured for casing. In embodiments, controls might be integrated (into the rig control system) to automatically control the fingerboard (casing or drill pipe configuration). In embodiments, controls might be integrated to position and reach of the pipe racker.

The preferred embodiments described herein are for illustrative purposes. The scope of the invention is defined by the following claims and includes the full range of equivalents to the elements recited.

What is claimed is:

1. A fingerboard for a drilling rig comprising:

a fixed fingerboard section comprising at least two fingers defining a slot and a pipe receiving space for receiving at least one pipe;

a movable fingerboard section comprising a first pipe receiving portion with a first pipe receiving space and a second pipe receiving portion with a second pipe receiving space;

at least one hinge for selectively positioning said movable fingerboard section in a first position wherein said first pipe receiving portion is adjacent to said fixed fingerboard section and for selectively positioning said movable fingerboard section in a second position wherein said second pipe receiving portion is adjacent to said fixed fingerboard section; and a mover affixed to said movable fingerboard section for moving said movable fingerboard section between said first position and said second position.

2. The fingerboard according to claim 1, wherein said fixed fingerboard section has a plurality of latches arranged between said fingers for defining said pipe receiving space, and wherein each latch of said plurality of latches is selectively movable between an open position and a closed position.

3. The fingerboard according to claim 1.

wherein said first pipe receiving portion comprises at least two fingers defining a first pipe receiving slot and a plurality of latches arranged between said fingers for defining said first pipe receiving space for receiving a first pipe having a first diameter, and wherein said second pipe receiving portion comprises at least two fingers defining a second pipe receiving slot and a plurality of latches arranged between said fingers for defining said second pipe receiving space for receiving a second pipe having a second diameter.

4. The fingerboard according to claim 1 wherein:

said first pipe receiving space is the same size as the pipe receiving space of the fixed fingerboard section.

5. The fingerboard according to claim 1 wherein:

said second pipe receiving space is larger than said first pipe receiving space.

6. The fingerboard according to claim 1 wherein:

said second pipe receiving space is sized to receive casing pipes.

7. The fingerboard according to claim 1 wherein the least one hinge is connected to said first pipe receiving portion and said second pipe receiving portion of said movable fingerboard section.

8. The fingerboard according to claim 1, wherein said first pipe receiving portion and said second pipe receiving portion of said moveable fingerboard section are offset from one another by an angle.

9. The fingerboard according to claim 1 wherein the pipe receiving space of the fixed fingerboard section is sized to receive drill pipes.

10. The fingerboard according to claim 1 wherein:

said mover is a hydraulic cylinder.

11. The drilling rig according to claim 1, wherein said mover is controlled via a control system, and wherein said control system interfaces with controls of a pipe handling system.

12. A drilling rig for drilling a well, said drilling rig comprising:

a rig floor;

a derrick extending above said rig floor, said derrick supporting tubular handling equipment;

a support structure affixed to said derrick, said support structure supporting a fixed fingerboard section and a movable fingerboard section;

said fixed fingerboard section comprising at least two fingers defining a slot and a pipe receiving space for receiving a pipe;

said movable fingerboard section comprising a first pipe receiving portion and a second pipe receiving portion, said first pipe receiving portion having a first pipe receiving space for receiving a first pipe, said second pipe receiving portion having a second pipe receiving space for receiving a second pipe;

a hinge affixed to said support structure, said hinge selectively positioning said movable fingerboard section in a first position wherein said first pipe receiving portion is adjacent to said fixed fingerboard section and for selectively positioning said movable fingerboard section in a second position wherein said second pipe receiving portion is adjacent to said fixed fingerboard section;

a mover affixed to said movable fingerboard section for moving said movable fingerboard section between said first position and said second position.

13. The drilling rig according to claim 12 further comprising:

a plurality of latches arranged between said fingers wherein each latch of said plurality of latches is selectively movable between an open position and a closed position; and wherein latches of said plurality of latches and said fingers define said pipe receiving space of said fixed fingerboard section.

14. The drilling rig according to claim 12, wherein said first pipe receiving portion comprises at least two fingers defining a first pipe receiving slot and a plurality of latches arranged between said fingers, wherein said at least two fingers define a first pipe receiving slot, and wherein said plurality of latches are arranged between said at least two fingers for defining said first pipe receiving portion.

15. The drilling rig according to claim 12, wherein said second pipe receiving portion comprises at least two fingers defining a second pipe receiving slot and a plurality of latches arranged between said fingers, wherein said at least two fingers define a second pipe receiving slot, and wherein said plurality of latches are arranged between said at least two fingers for defining said second pipe receiving portion.

16. The drilling rig according to claim 12 wherein:

said first pipe receiving portion and said second pipe receiving portion of said moveable fingerboard section are offset from one another by an angle.

17. The drilling rig according to claim 12 wherein:

the pipe receiving space of the fixed fingerboard section is able to receive drill pipes.

18. The drilling rig according to claim 17 wherein:

said first pipe receiving space is sized to receive at least one drill pipe.

19. The drilling rig according to claim 12 wherein:

said second pipe receiving space is larger than said first pipe receiving space.

20. The drilling rig according to claim 12 wherein:

said second pipe receiving space is sized to receive casing pipes.

21. The drilling rig according to claim 12 wherein the least one hinge is connected to said first pipe receiving portion and said second pipe receiving portion of said movable fingerboard section.

22. The drilling rig according to claim 12 wherein:

said mover is a hydraulic cylinder.

23. The drilling rig according to claim 12, wherein said mover is controlled via a control system, and wherein said control system of said mover interfaces with controls of a pipe handling system.

24. A method for handling multiple tubulars with a fingerboard for a drilling rig, said method comprising the steps of:

affixing a fixed fingerboard section to a support structure, said fixed fingerboard comprising at least two fingers defining a slot and a drill pipe receiving space;

affixing a movable fingerboard section to said support structure, said movable fingerboard section having a first pipe receiving portion and a second pipe receiving portion, said first pipe receiving portion comprising a first pipe receiving space, said second pipe receiving portion comprising a second pipe receiving space;

selectively positioning said movable fingerboard section in a first position wherein said first pipe receiving portion is adjacent said fixed fingerboard section and selectively positioning said movable fingerboard section in a second position wherein said second pipe receiving portion is adjacent to said fixed fingerboard section.

* * * * *